US012075856B2

(12) United States Patent
Strobel et al.

(10) Patent No.: US 12,075,856 B2
(45) **Date of Patent: *Sep. 3, 2024**

(54) POWER MESH PANELS FOR TUMMY-COVERING GARMENTS

(71) Applicant: Torrid LLC, City of Industry, CA (US)

(72) Inventors: Heather A. Strobel, Pasadena, CA (US); Elizabeth Munoz-Guzman, Arcadia, CA (US)

(73) Assignee: Torrid LLC, City of Industry, CA (US)

( * ) Notice: Subject to any disclaimer, the term of this patent is extended or adjusted under 35 U.S.C. 154(b) by 69 days.

This patent is subject to a terminal disclaimer.

(21) Appl. No.: 17/977,115

(22) Filed: Oct. 31, 2022

(65) Prior Publication Data

US 2023/0046224 A1 Feb. 16, 2023

Related U.S. Application Data

(63) Continuation of application No. 17/859,572, filed on Jul. 7, 2022, which is a continuation of application No. 17/239,392, filed on Apr. 23, 2021, now Pat. No. 11,510,442.

(60) Provisional application No. 63/015,339, filed on Apr. 24, 2020.

(51) Int. Cl.
*A41D 1/06* (2006.01)
*A41F 9/00* (2006.01)

(52) U.S. Cl.
CPC ..... *A41D 1/06* (2013.01); *A41F 9/00* (2013.01); *A41D 2400/38* (2013.01)

(58) Field of Classification Search
CPC ..... A41D 1/06; A41D 2400/38; A41F 9/00
USPC ..... 2/227
See application file for complete search history.

(56) References Cited

U.S. PATENT DOCUMENTS

| | | | | |
|---|---|---|---|---|
| 1,835,499 | A | 12/1931 | Kotzin | |
| 2,713,685 | A | 7/1955 | Nachem | |
| 3,678,514 | A | 7/1972 | Safrit | |
| 4,914,756 | A | 4/1990 | Grassick | |
| 6,035,448 | A * | 3/2000 | Thomson | A41D 1/06 2/237 |
| 7,950,069 | B2 | 5/2011 | Lee | |

(Continued)

FOREIGN PATENT DOCUMENTS

| | | | |
|---|---|---|---|
| CN | 1989916 | A | 7/2007 |
| CN | 106714597 | A | 5/2017 |

*Primary Examiner* — Alissa J Tompkins
*Assistant Examiner* — Catherine M Ferreira
(74) *Attorney, Agent, or Firm* — Sheppard, Mullin, Richter & Hampton LLP

(57) ABSTRACT

Mesh fabric panels that provide a compressive force to a wearer's mid-section and tummy-covering garments equipped with the mesh fabric panels are disclosed. The mesh fabric panels can be formed of a material having a suitable rigidity for providing the compressive force. The mesh fabric panels include left and right panels adapted to be stitched or otherwise affixed to left and right front sections, respectively, of a garment such as a pant, a dress, a skirt, shorts, swimwear, or the like. Each of the left and right mesh fabric panels includes a seam side edge adapted to be affixed to a corresponding seam side of a tummy-covering garment, a fly side edge adapted to be affixed to a fly facing of the garment, a waist edge, and a bottom edge. The left and/or right mesh fabric panel may be a dual layer panel.

9 Claims, 10 Drawing Sheets

(56) References Cited

U.S. PATENT DOCUMENTS

| | | | | |
|---|---|---|---|---|
| 8,732,865 | B2 * | 5/2014 | Ishikawa | A41D 1/06 2/401 |
| 8,959,665 | B1 * | 2/2015 | Garner | A41F 9/02 2/237 |
| 9,307,794 | B1 * | 4/2016 | Rumsey | A41D 1/067 |
| D793,033 | S * | 8/2017 | Neary | D2/742 |
| 9,801,420 | B2 * | 10/2017 | Hays | A41D 1/06 |
| 10,154,702 | B1 * | 12/2018 | Neary | A41D 1/06 |
| 10,285,457 | B2 * | 5/2019 | Roup | A41D 1/14 |
| 10,980,299 | B1 * | 4/2021 | Neary | A41D 1/06 |
| 11,096,430 | B2 * | 8/2021 | Otashevich | A41D 1/06 |
| 11,166,504 | B2 * | 11/2021 | Otashevich | A41D 31/04 |
| 2010/0175166 | A1 | 7/2010 | Bradt | |
| 2010/0192284 | A1 * | 8/2010 | Simon | A41D 1/06 2/243.1 |
| 2011/0099677 | A1 * | 5/2011 | Mamiye | A41D 27/02 2/400 |
| 2011/0131705 | A1 * | 6/2011 | Waldman | A41F 9/00 2/221 |
| 2016/0073718 | A1 * | 3/2016 | McKinlay | A41D 27/08 450/95 |
| 2016/0120246 | A1 | 5/2016 | Boyle et al. | |
| 2017/0318864 | A1 | 11/2017 | Carroll et al. | |
| 2017/0347719 | A1 | 12/2017 | Laffey | |
| 2018/0235291 | A1 | 8/2018 | Roup | |
| 2018/0289081 | A1 | 10/2018 | Schierenbeck et al. | |
| 2018/0310639 | A1 | 11/2018 | House et al. | |
| 2019/0150540 | A1 | 5/2019 | Otashevich et al. | |
| 2019/0320746 | A1 | 10/2019 | Otashevich et al. | |
| 2019/0320747 | A1 | 10/2019 | Otashevich et al. | |
| 2020/0093206 | A1 * | 3/2020 | Hart | A41D 1/22 |
| 2020/0260808 | A1 * | 8/2020 | Waldman | A41D 27/02 |
| 2022/0151312 | A1 | 5/2022 | Schramm et al. | |

* cited by examiner

POWER MESH PANELS FOR TUMMY-COVERING GARMENTS

CROSS-REFERENCE TO RELATED APPLICATION(S)

This is a continuation application of and claims priority to U.S. Non-Provisional application Ser. No. 17/859,572, filed on Jul. 7, 2022, which claims priority to U.S. Non-Provisional application Ser. No. 17/239,392, filed on Apr. 23, 2021, now U.S. Pat. No. 11,510,442, which claims the benefit of U.S. Provisional Application No. 63/015,339, filed on Apr. 24, 2020, the content of which is incorporated by reference herein in its entirety.

TECHNICAL FIELD

This disclosure pertains to garments, and more particularly, to pants and/or other tummy-covering garments configured to provide a compressive force against a mid-section of a wearer.

BACKGROUND

Pants are available in a variety of styles and fits that cater to wide range of wearer preferences. For example, pants are available across a range of fits from "skinny" that is relatively form-fitting to "relaxed" that is relatively loose-fitting. Conventionally, pants are selected to match functional preferences (e.g., fit and comfort) and/or aesthetic preferences (e.g., color and/or pattern) of a wearer.

FIGS. 1A, 1B, 2A, and 2B depict various prior art left and right mesh fabric panels adapted to be stitched to left and right sections of a pant. FIG. 3 depicts the prior art left and right panels of FIGS. 2A and 2B sewn into a pant.

Referring now to FIG. 1A, a prior art left mesh fabric panel 100A is depicted in an unfolded state prior to being folded at a medial line 114A to form a prior art dual layer left mesh fabric panel which can then be sewn into a pant. The left mesh fabric panel 100A includes a first seam side edge 106A, a first fly side edge 110A, and a first waist edge 102A. The left mesh fabric panel 100A further includes a second seam side edge 108A, a second fly side edge 112A, and a second waist edge 104A. The left mesh fabric panel 100A includes a medial line 114A along a center width of the panel 100A, that separates a top portion of the panel 100A (defined by the medial line 114A, the first seam side edge 106A, the first fly side edge 110A, and the first waist edge 102A) from a bottom portion of the panel 100A (defined by the medial line 114A, the second seam side edge 108A, the second fly side edge 112A, and the second waist edge 104A).

The top portion and the bottom portion of the prior art left mesh fabric panel 100A are mirror images of each other across the medial line 114A. That way, when the left mesh fabric panel 100A is folded along the medial line 114A, the top portion and the bottom portion overlap. More specifically, when the left mesh fabric panel 110A is folded along the medial line 114A, the first seam side edge 106A, the first fly side edge 110A, and the first waist edge 102A correspond with the second seam side edge 108A, the second fly side edge 112A, and the second waist edge 104A, respectively.

FIG. 2A depicts a prior art folded left mesh fabric panel 200A that is achieved by folding the left mesh fabric panel 100A of FIG. 1A at the medial line 114A. A fold 202A is generated at the medial line 114A that effectively becomes a bottom edge of the folded left mesh fabric panel 200A. When folded, the top and bottom portions of the left mesh fabric panel 100A overlap to form the dual layer mesh fabric panel 200A. The dual layer folded left mesh fabric panel 200A is sewn into a left side section of a pant as illustrated in FIG. 3.

As further shown in FIG. 1A, the first waist edge 102A of the left mesh fabric panel 100A has a concave shape. The second waist edge 104A has a mirror image shape across the medial line 114A as the first waist edge 102A.

For a size 18 pant, and prior to being sewn into a tummy-covering garment, the first waist edge 102A width and the second waist edge 104A width is 11". The term "unattached" is used herein to refer to any dimensions provided herein for a mesh fabric panel that is in a state of not being affixed to a tummy-covering garment. Similarly, the term "attached" is used herein to refer to any dimensions of panel that is in a state of being affixed (e.g., sewn into) a tummy-covering garment. The first seam side edge 106A unattached length (i.e., distance of the first seam side edge 106A from the first waist edge 102A to the medial line 114A) and the second seam side edge 108A unattached length (i.e., distance of the second seam side edge 108A from the second waist edge 104A to the medial line 114A) is 6". As a result, a seam side unattached length of the double layer left mesh fabric panel 200A of FIG. 2A after folding the left mesh fabric panel 100A at the medial line 114A is also 6".

For a size 18 pant, the first fly side edge 110A unattached length (i.e., distance of the first fly side edge 110A from the first waist edge 102A to the medial line 114A) and the second fly side edge 112A unattached length (i.e., distance of the second fly side edge 112A from the second waist edge 104A to the medial line 114A) is 5.25". As a result, a fly side unattached length of the double layer left mesh fabric panel 200A of FIG. 2A after folding the left mesh fabric panel 100A at the medial line 114A is also 5.25".

As depicted in FIG. 1A, each of the first fly side edge 110A and the second fly side edge 112A are colinear. Moreover, as further depicted in FIG. 1A, each of the first seam side edge 106A and the second seam side edge 108A are linear and mirror images of each other across the medial line 114A. In particular, as shown in FIG. 1A, the first seam side edge 106A and the second seam side edge 108A form an angle therebetween slightly below 180 degrees on the fabric side. The angle results in an unattached fold width (i.e., an unattached width of the fold line 202A of the double layer left mesh fabric panel 200A, also becoming herein the bottom edge of the panel 200A) that is 0.5" greater than the panel waist width (i.e., the unattached width of the first waist edge 102A and second waist edge 104A). That is, assuming a size 18 pant, the panel waist unattached width of the prior art left mesh fabric panel 100A is 11" while the unattached fold width is greater (i.e., 11.5") due to the angle formed between the first seam side edge 106A and the second seam side edge 108A.

FIG. 1B depicts a prior art right mesh fabric panel 100B that is a right counterpart to the prior art left mesh fabric panel 100A of FIG. 1A. As with the left mesh fabric panel 100A, the right mesh fabric panel 100B is depicted in an unfolded state prior to being folded at a medial line 114B and sewn into a pant. The prior art right mesh fabric panel 100B includes a first seam side edge 106B, a first fly side edge 110B, and a first waist edge 102B. The right mesh fabric panel 100B further includes a second seam side edge 108B, a second fly side edge 112B, and a second waist edge 104B. The medial line 114B identifies a center width of the panel 100B, that separates a top portion of the right mesh fabric panel 100B (defined by the medial line 114B, the first seam side edge 106B, the first fly side edge 110B, and the first waist edge 102B) from a bottom portion of the right mesh fabric panel 100B (defined by the medial line 114B, the second seam side edge 108B, the second fly side edge 112B, and the second waist edge 104B).

As with the left mesh fabric panel 100A, the top portion and the bottom portion of the panel 100B are mirror images of each other across the medial line 114B. That way, if the panel 100B is folded along the medial line 114B, the top portion and the bottom portion substantially overlap, and the first seam side edge 106B, the first fly side edge 110B, and the first waist edge 102B correspond with the second seam side edge 108B, the second fly side edge 112B, and the second waist edge 104B, respectively.

The first waist edge 102B has a curve shape. By virtue of the top and bottom portions of the panel 100B being mirror images of one another, the second waist edge 104B has a mirror image shape of the first waist edge 102B (the same radius of curvature).

FIG. 2B depicts a prior art dual layer folded right mesh fabric panel 200B that is achieved by folding the right mesh fabric panel 100B at the medial line 114B. A fold 202B is generated at the medial line 114B and effectively becomes the bottom edge of the dual layer right mesh fabric panel 200B. When folded, the top and bottom portions of the right mesh fabric panel 100B overlap to form the dual layer mesh fabric panel 200B. The dual layer right mesh fabric panel 200B is sewn into a right side section of a pant, as illustrated in FIG. 3.

The prior art right mesh fabric panel 100B has the same shape and dimensions as the prior art left mesh fabric panel 100A, albeit possibly as a left to right mirror image and possibly accounting for differences between the left seam of the fly facing and the right seam of the fly facing. That is, for a size 18 pant, and assuming no differences need to be accounted for between the left and right sides of the fly facing, the unattached width of each of the first waist edge 102B and the second waist edge 104B is 11", the unattached length of each of the first seam side edge 106B and the second seam side edge 108B is 6", and the unattached length of each of the first fly side edge 110B and the second fly side edge 112B is 5.25". Moreover, the first seam side edge 106B and the second seam side edge 108B form an angle therebetween slightly below 180 degrees on the fabric side that is a mirror image of the angle formed between the seam side edges 106A, 108A of the left mesh fabric panel 100A), and as a result, an unattached fold width of the panel 100B is 11.5", i.e., 0.5" greater than the panel waist width (11").

Referring now to FIG. 3, the prior art left and right mesh fabric panels 100A, 100B are depicted as stitched into or otherwise affixed to the inside of the pant 300. More specifically, the left mesh fabric panel 100A is folded at the medial line 114A to obtain the prior art double layer left mesh fabric panel 200A, which is then stitched to the pant 300. The first waist edge 102A and the second waist edge 104A of the double layer left mesh fabric panel 200A is sewn to a waist seam of the pant 300. The first seam side edge 106A and the second seam side edge 108A are sewn to a left hip seam 306A of the pant 300. The first fly side edge 110A and the second fly side edge 112A are sewn to a left side of a fly facing 302 of the pant 300.

The prior art right mesh fabric panel 100B is folded at the medial line 114B to achieve the prior art double layer right mesh fabric panel 200B, which is then stitched to the pant 300. The first waist edge 102B and the second waist edge 104B of the double layer right mesh fabric panel 200B is sewn to a waist seam of the pant 300. The first seam side edge 106B and the second seam side edge 108B are sewn to a right hip seam 306B of the pant 300. Further, the first fly side edge 110B and the second fly side edge 112B are sewn to a right side of the fly facing 302 of the pant 300. It should be appreciated that a corner of the fly facing 302 is shown in FIG. 3 as being flipped up to reveal a curved portion of the fly facing 302 underneath the flipped up corner.

As depicted in FIG. 3, the left mesh fabric panel 200A is shorter than the front fly facing 302 and shorter than a left pocket bag 304A of the pant 300, and the right mesh fabric panel 200B is shorter than the front fly facing 302 and shorter than a right pocket bag 304B of the pant 300. Therefore, the outline of the pocket bags are often visible in the pant, thereby affecting the aesthetics of the pant 300.

As previously noted, an unattached width of each of the prior art left and right mesh fabric panels 200A, 200B at the waist seam is 11", which is 0.5" wider than the waist seam of the pant 300, the waist seam of the pant being 10.5". Moreover, an unattached fold width of each of the prior art left and right mesh fabric panels 200A, 200B at the bottom edge is 11.5", which is 0.75" wider than a width of the pant section at a corresponding distance from the waist seam, the width of the pant section at the corresponding distance from the waist seam being about 10.75.

As previously noted, the dimensions provided above are unattached dimensions before the panels 200A, 200B are sewn into the pant 300 and include a 0.5" tolerance at each sewn edge. Accordingly, each of the left and right mesh fabric panels 200A, 200B lose 1" in width at the waist when the first waist edge and second waist edge are sewn at the waist seam and lose 0.5" at each of the seam side and the fly side as well. Thus, assuming a size 18 pant and the unattached panel dimensions described earlier, after each panel 200A, 200B is sewn into a respective front section of the pant 300, the waist line attached width of each panel becomes 10", the attached length of the seam side edges becomes 5.5", and the attached length of the fly side edges becomes 4.75". Further, after being sewn into the pant 300, each prior art panel 200A, 200B has an attached fold line width of 10.5" due to a total loss of 1" including a loss of 0.5" from being sewn at the seam side and another 0.5" from being sewn at the fly side.

As noted above, after being sewn into the pant 300, each prior art panel 200A, 200B has an attached waist seam width of 10". Further, as previously noted, the waist seam width of a corresponding section of the pant 300 is 10.5". Thus, the panels 200A, 200B provide 0.5" of compression at the waist which translates to about 1.85% of compression at the high hip position. Further, as noted above, after being sewn into the pant 300, each prior art panel 200A, 200B has an attached fold line width of 10.5". Since, as previously noted, a width of the pant section at a corresponding distance from the waist seam as the fold line is 10.75 the prior art panels 200A, 200B provide greater compression (0.25") at the bottom edge than at the waist line. This corresponds to 0.91% of compression at the low hip.

In addition, the prior art left mesh fabric panel 200A and/or the prior art right mesh fabric panel 200B may be provided with extra fabric 308 at the bottom edge (i.e., along the fold line) in relation to the pant section. As such, the left mesh fabric panel 200A and/or the right mesh fabric panel 200B may be provided with ease at the bottom edge such that the panels are not stretched at the fold when laid flat, but provide even less compression.

Panels that provide improved compression and possibly improved shaping without affecting wearer comfort are needed.

SUMMARY

Embodiments of the disclosure relate to mesh fabric panels that provide a compressive force to a wearer's mid-section and tummy-covering garments equipped with the mesh fabric panels. In some embodiments, the mesh fabric panels are formed of a material having a rigidity suitable for providing the compressive force, e.g., a rigidity greater than the garment material to which it is affixed. In some embodiments, the mesh fabric panels include left and right panels adapted to be stitched or otherwise affixed to left and right front sections, respectively, of a garment such as a pant (e.g., a denim pant), a dress, a skirt, shorts, swimwear, or the like. For ease of explanation, example embodiments are described herein using a pant as an example garment and stitching as an example means for affixing the mesh fabric to the garment. It should be appreciated, however, that embodiments of the disclosure are applicable to other types of garments, and mechanisms other than sewing can be used to affix the mesh fabric to a garment including, without limitation, tape, glue, or another type of adhesive.

In one or more embodiments, a mesh fabric panel configured to apply a compressive force to a wearer of a tummy-covering garment when the mesh fabric panel is affixed to the tummy-covering garment is disclosed. The mesh fabric panel includes a first fly side edge adapted to be affixed to a fly facing of a tummy-covering garment, where the first fly side edge is at least as long as the fly facing of the tummy-covering garment; a first seam side edge opposite the first fly side edge and having a curve shape; a first waist edge; and a bottom edge opposite the first waist edge. The first seam side edge is adapted to be affixed to a first hip seam of the tummy-covering garment and the first waist edge is adapted to be affixed to a waist seam of the tummy-covering garment.

In some embodiments, the curve shape of the first seam side edge is more pronounced than a garment curve along the first hip seam of the tummy-covering garment. In some embodiments, the curve shape of the first seam side edge is a reducing curve shape in the direction of the first waist edge to the bottom edge.

In some embodiments, the first waist edge also has a curve shape.

In some embodiments, the first fly side edge is substantially linear.

In some embodiments, the mesh fabric panel includes dual layer mesh fabric.

In some embodiments, the mesh fabric panel further includes a second fly side edge that meets the first fly side edge at a medial line of the mesh fabric panel; a second seam side edge that meets that first seam side edge at the medial line; and a second waist edge. In some embodiments, the bottom edge of the mesh panel fabric is defined by a fold that is created when the mesh fabric panel is folded at the medial line, thereby creating a dual layer mesh fabric panel.

In some embodiments, the dual layer mesh fabric panel includes a built-in pocket bag.

In some embodiments, the first waist edge, the first seam side edge, the first fly side edge, and the medial line define a top portion of the mesh fabric panel; the second waist edge, the second seam side edge, the second fly side edge, and the medial line define a bottom portion of the mesh fabric panel; and the top portion and the bottom portion substantially overlap when the mesh fabric panel is folded at the medial line.

In some embodiments, the first waist edge, the first seam side edge, and the first fly side edge substantially correspond with the second waist edge, the second seam side edge, and the second fly side edge, respectively, when the mesh fabric panel is folded at the medial line.

In some embodiments, the first seam side edge and the first fly side edge of the mesh fabric panel is longer than the fly facing of the tummy-covering garment such that the bottom edge sits below a bottom end of the fly facing when the mesh fabric panel is affixed to the tummy-covering garment.

In some embodiments, the first seam side edge and the first fly side edge of the mesh fabric panel is longer than a pocket bag of the tummy-covering garment such that the bottom edge of the mesh fabric panel sits below a bottom edge of the pocket bag when the mesh fabric panel affixed to the tummy-covering garment.

In one or more embodiments, a pant having mesh fabric panels configured to apply a compressive force to a wearer of the pant is disclosed. The pant has a waist seam, a fly facing having a left fly facing seam and a right fly facing seam, a left hip seam, and a right hip seam. The pant further includes a left mesh fabric panel and a right mesh fabric panel. The left mesh fabric panel includes a first left fly side edge adapted to be affixed to the left fly facing seam, where the first left fly side edge is at least as long as the fly facing; a first left seam side edge adapted to be affixed to the left hip seam and having a curve shape; a first left waist edge adapted to be affixed to the waist seam; and a first left bottom edge opposite the left waist edge. The right mesh fabric panel includes a first right fly side edge adapted to be affixed to the right fly facing seam, where the first right fly side edge is at least as long as the fly facing; a first right seam side edge adapted to be affixed to the right hip seam and having a curve shape; a first right waist edge adapted to be affixed to the waist seam; and a first right bottom edge opposite the right waist edge.

In some embodiments, the curve shape of each of the first left seam side edge and the first right seam side edge is a reducing curve shape in the direction of the first waist edge to the bottom edge.

In some embodiments, the curve shape of the first left seam side edge and/or the curve shape of the first right seam side edge is more pronounced than a garment curve along the left hip seam or the right hip seam, respectively.

In some embodiments, each of the left and right mesh fabric panels includes dual layer mesh fabric.

In some embodiments, the left mesh fabric panel further includes a second left fly side edge that meets the first left fly side edge at a medial line of the left mesh fabric panel; a second left seam side edge that meets that first left seam side edge at the medial line; and a second left waist edge. In some embodiments, the left bottom edge is defined by a fold that is created when the left mesh fabric panel is folded at the medial line, thereby creating a dual layer left mesh fabric panel.

Similarly, in some embodiments, the right mesh fabric panel may further include a second left fly side edge that meets the first left fly side edge at a medial line of the left mesh fabric panel; a second left seam side edge that meets that first left seam side edge at the medial line; and a second left waist edge. In some embodiments, the right bottom edge is defined by a fold that is created when the right mesh fabric panel is folded at the medial line, thereby creating a dual layer left mesh fabric panel.

In some embodiments, the dual layer left mesh fabric panel and/or the dual layer right mesh fabric panel includes a built-in pocket bag.

In some embodiments, each of the first left seam side edge, the first right seam side edge, the first left fly side edge and the first right fly side edge is longer than the fly facing of the pant such that each of the left bottom edge and the right bottom edge sits below a bottom end of the fly facing when affixed to the pant.

In some embodiments, each of the first left seam side edge, the first right seam side edge, the first left fly side edge and the first right fly side edge is longer than a pocket bag of the pant such that each of the left bottom edge and the right bottom edge sits below a bottom edge of the pocket bag when affixed to the pant.

These and other features of the articles of manufacture disclosed herein will become more apparent upon consideration of the following description and the appended claims with reference to the accompanying drawings, all of which form a part of this specification, wherein like reference numerals designate corresponding parts in the various figures. It is to be expressly understood, however, that the drawings are for purposes of illustration and description only and are not intended as a definition of the limits of the invention.

DETAILED DESCRIPTION

Various garments are manufactured in a variety of sizes, fits, designs, etc. to match the functional preferences (e.g., fit and/or comfort) and/or aesthetic preferences (e.g., color and/or pattern) of a varied consumer base. Certain garments are available across a wide spectrum of fits/styles ranging from tight fit to normal fit to loose fit to oversized fit. Despite the wide selection of fits, conventional pants and other tummy-covering garments such as skirts, dresses, shorts, swimsuits, etc., do not offer tummy-flattening benefits to the wearer.

In some embodiments, mesh fabric panels according to embodiments of the present invention are adapted to be sewn into tummy-covering garments of a wide range of fits/styles/sizes. As such, a consumer can purchase a tummy-covering garment, for example, a pant that provides a desired comfort/fit and at the same time also provides compression due to the rigidity of mesh fabric panels sewn therein. In some embodiments, the mesh fabric panels may provide compression without altering the comfort, style, look and/or feel of the tummy-covering garment.

Figure 1A:
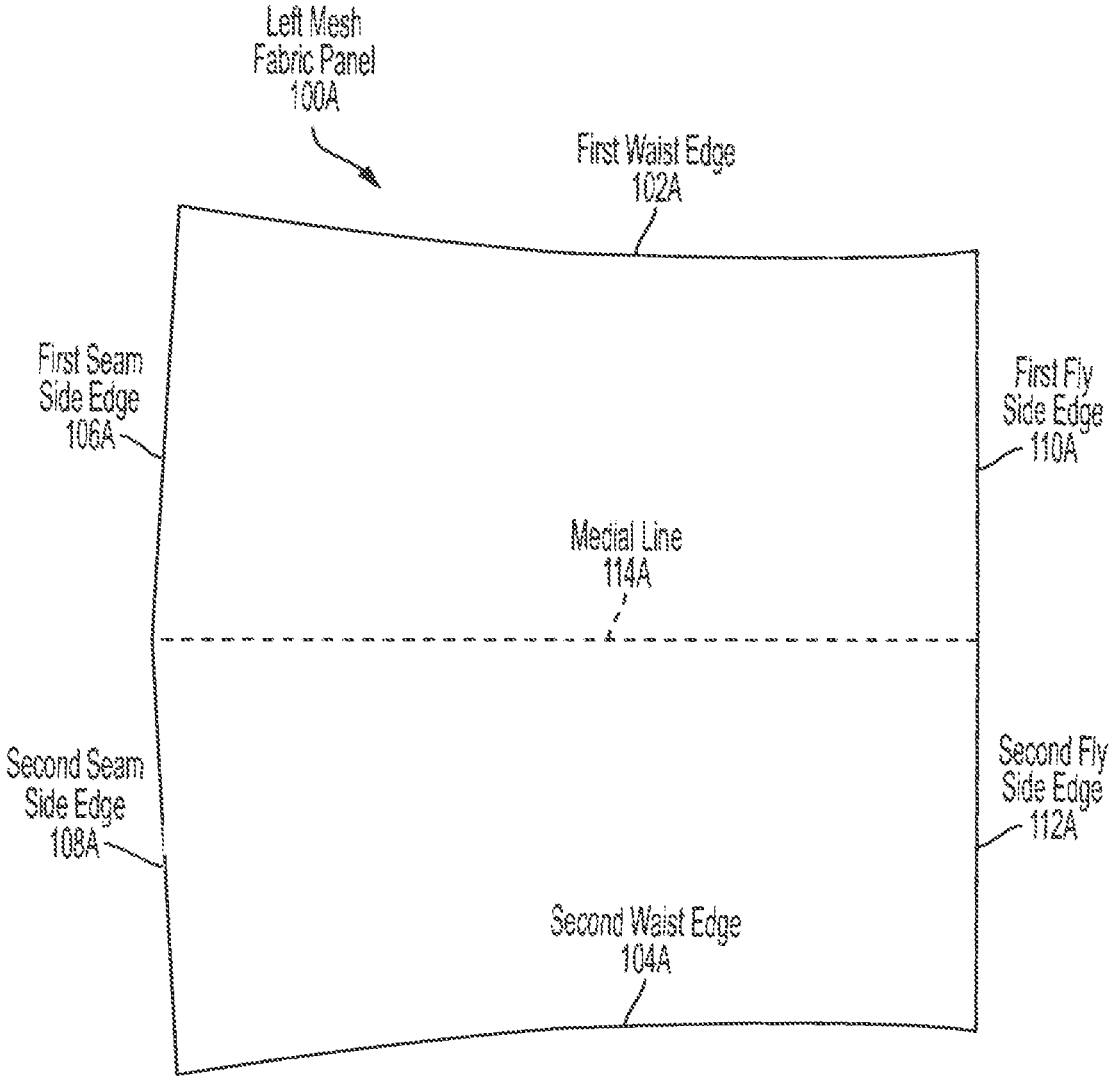
FIG. 1A depicts a prior art left mesh fabric panel.
Figure 1B:
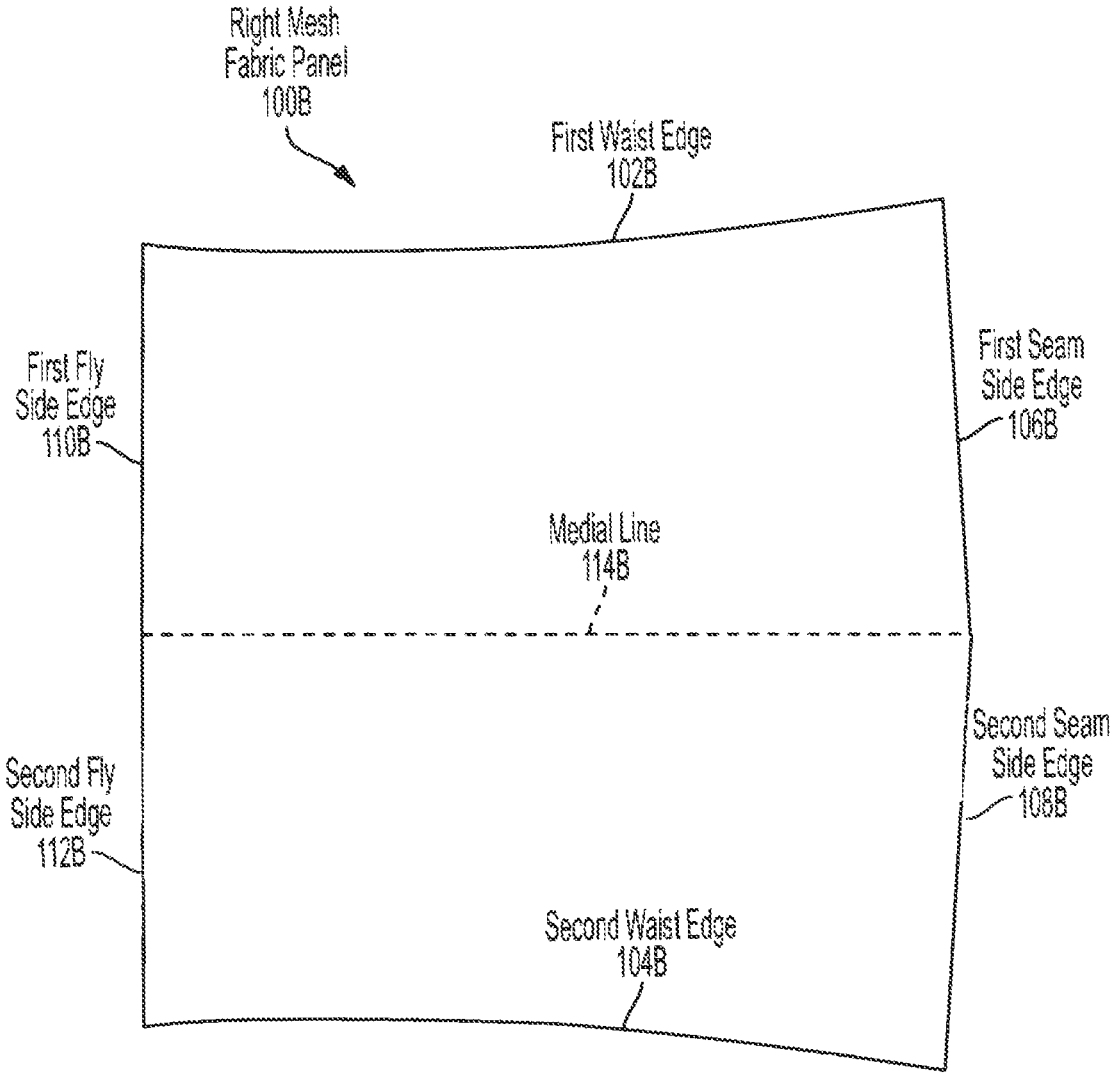
FIG. 1B depicts a prior art right mesh fabric panel.
Figure 2B:
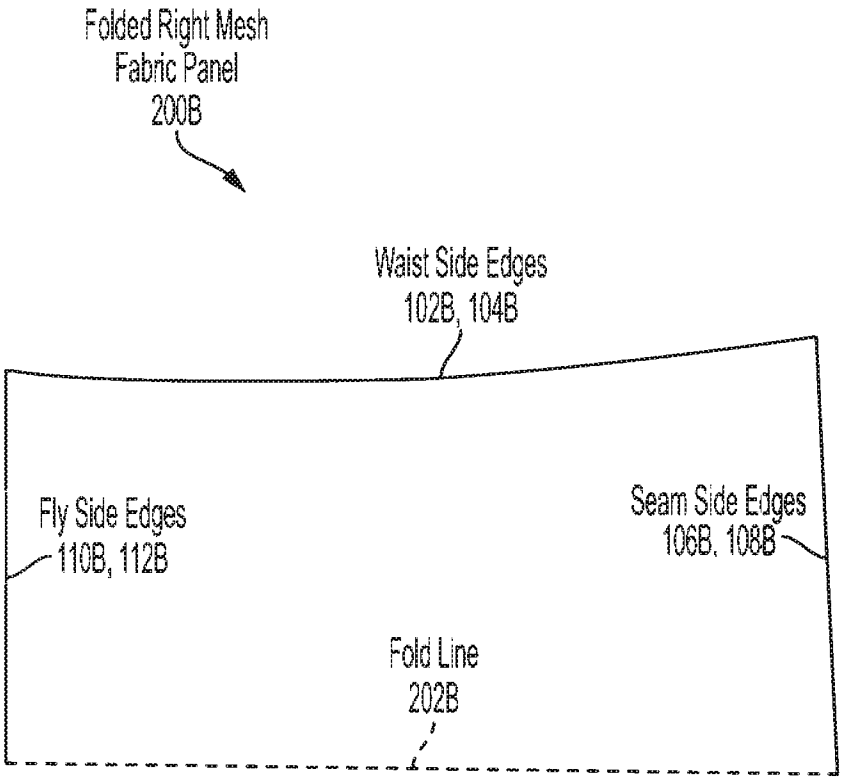
FIG. 2B depicts a right double mesh fabric panel obtained by folding the left mesh fabric panel of FIG. 1C along a medial line.
Figure 2A:
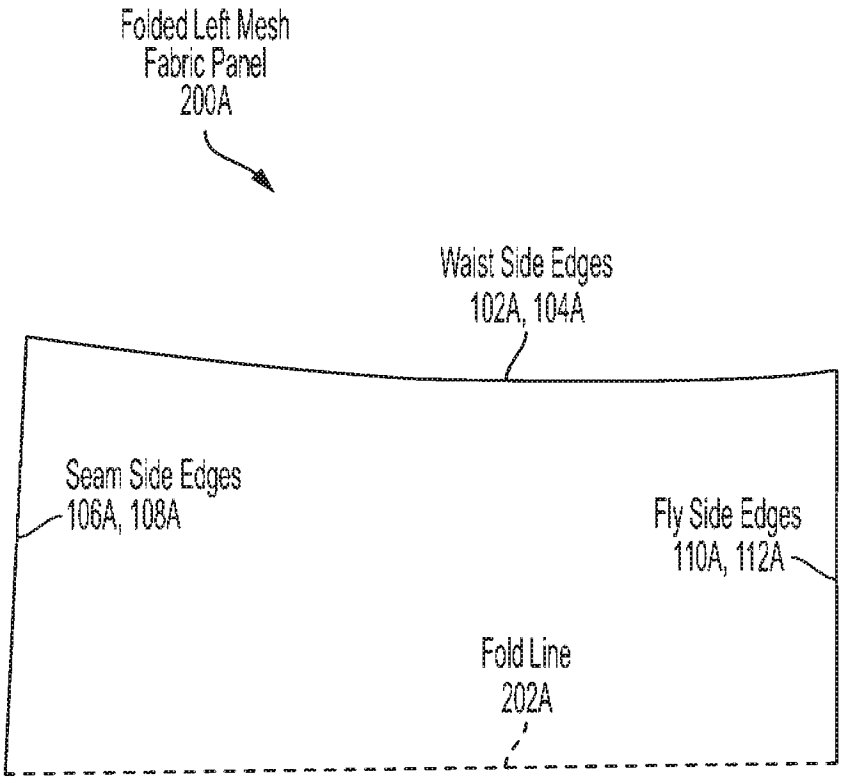
FIG. 2A depicts a left double mesh fabric panel obtained by folding the left mesh fabric panel of FIG. 1A along a medial line.
Figure 3:
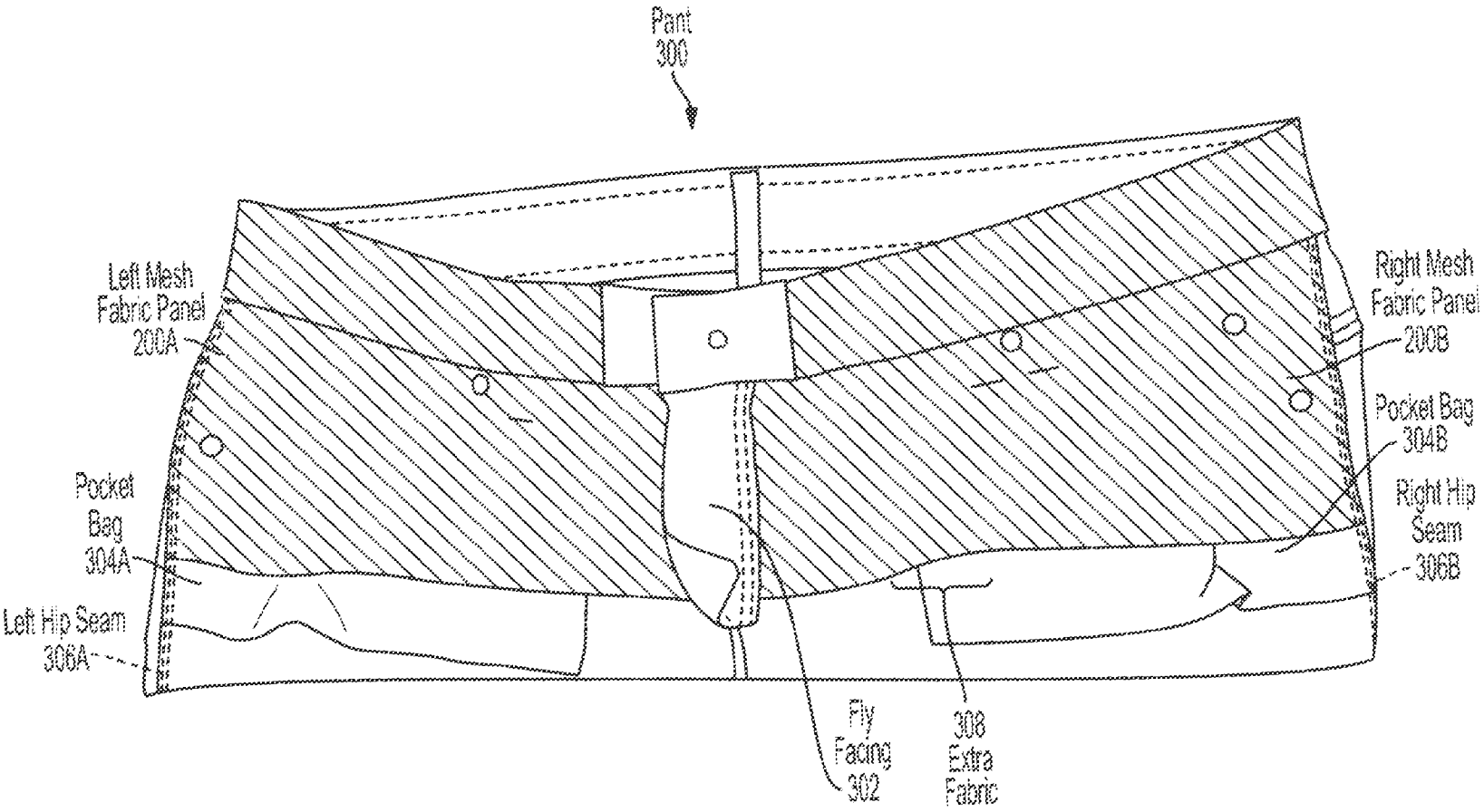
FIG. 3 depicts the left and right double mesh fabric panels of FIGS. 2A and 2C sewn into an example pair of pants in accordance with some embodiments.
Figure 4A:
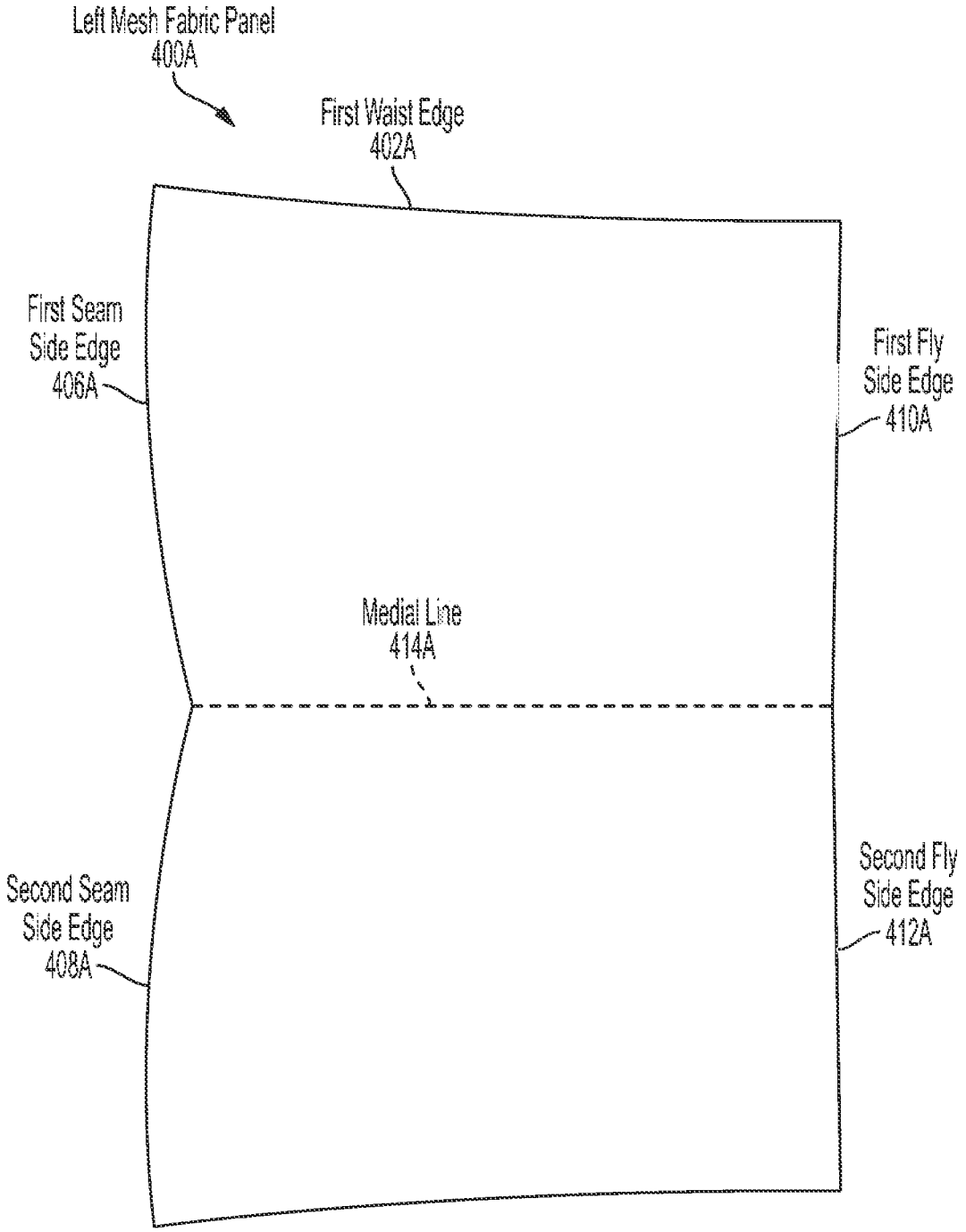
FIG. 4A depicts a left mesh fabric panel in accordance with some embodiments.
Figure 4B:
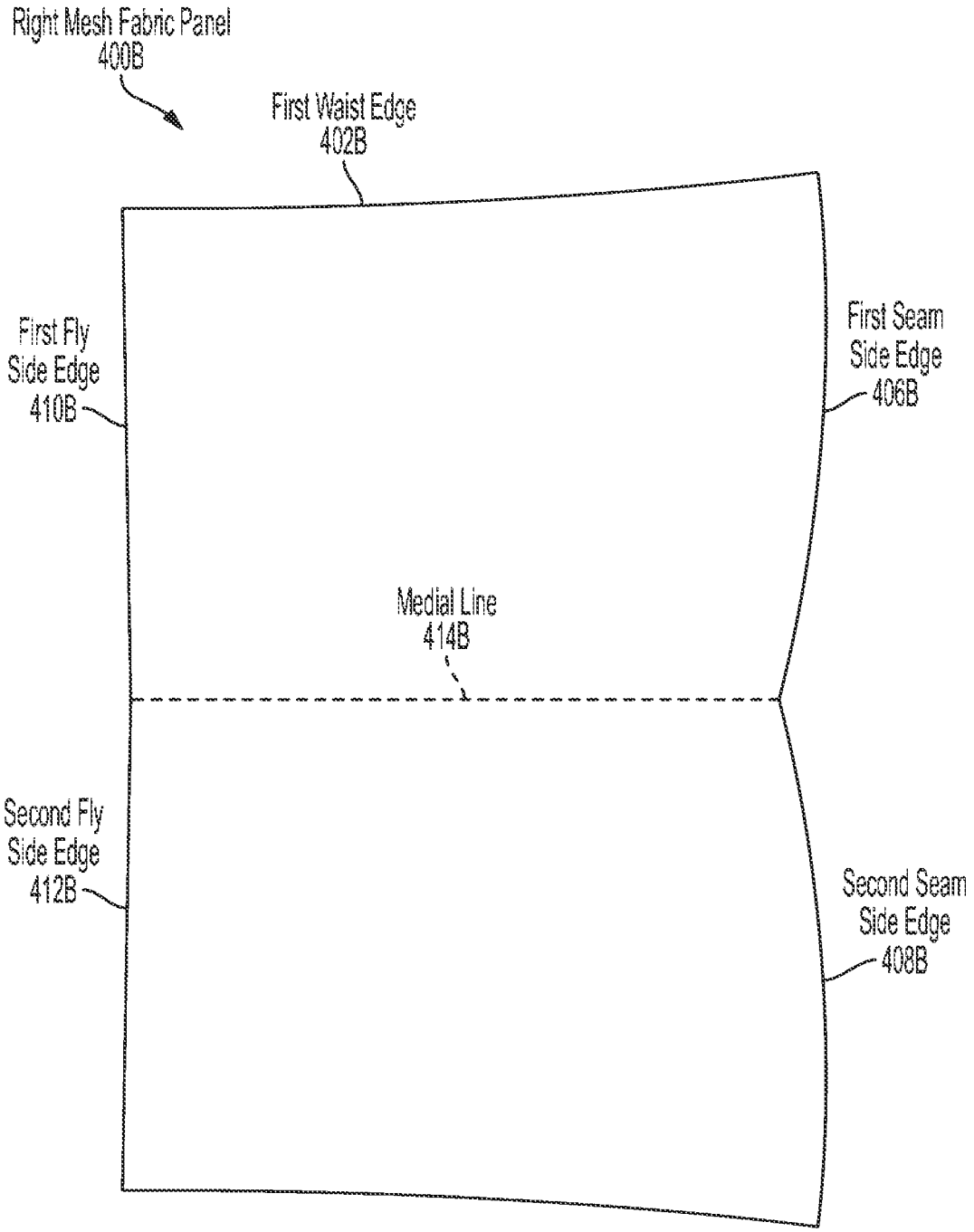
FIG. 4B depicts a right mesh fabric panel in accordance with the embodiments of FIG. 4A.
Figure 5B:
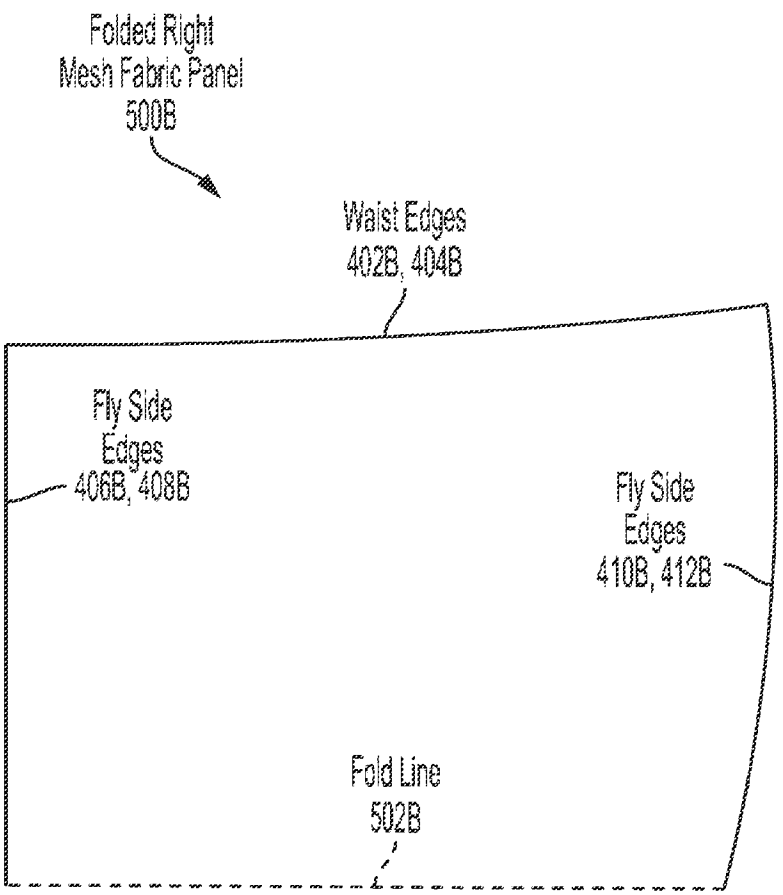
FIG. 5B depicts a right double mesh fabric panel obtained by folding the left mesh fabric panel of FIG. 4B along a medial line.

FIGS. 4A, 4B, 5A and 5B depict left and right mesh fabric panels according to some embodiments of the present invention. FIG. 6 depicts the left and right mesh fabric panels according to the embodiments shown in FIGS. 5A and 5B sewn into a pant. Because of increased length and altered shape of the left and right mesh fabric panels as compared to the prior art panels described earlier, the left and right mesh fabric panels of various embodiments of the present invention have been found to provide improved tummy-flattening effects and/or improved tummy-shaping effects, without compromising comfort.

Referring first to FIG. 4A, a left mesh fabric panel 400A according to an embodiment of the present invention is depicted in an unfolded state prior to being folded at a medial line 414A and sewn into a tummy-covering garment such as a pant. The left mesh fabric panel 400A includes a first seam side edge 406B, a first fly side edge 410A, and a first waist edge 402A. The left mesh fabric panel 400A further includes a second seam side edge 408A, a second fly side edge 412A, and a second waist edge 404A. In addition, the left mesh fabric panel 400A includes a medial line 414A that identifies a center width of the panel 400A, and separates a top portion of the panel 400A (defined by the medial line 414A, the first seam side edge 406A, the first fly side edge 410A, and the first waist edge 402A) from a bottom portion of the panel 400A (defined by the medial line 414A, the second seam side edge 408A, the second fly side edge 412A, and the second waist edge 404A).

In some embodiments, the top portion and the bottom portion of the panel 400A are mirror images of each other across the medial line 414A. That way, when the panel 400A is folded along the medial line 414A, the top portion and the bottom portion substantially overlap. Further, when the panel 400A is folded along the medial line 414A, the first seam side edge 406A, the first fly side edge 410A, and the first waist edge 402A may substantially correspond with the second seam side edge 408A, the second fly side edge 412A, and the second waist edge 404A, respectively.

Figure 5A:
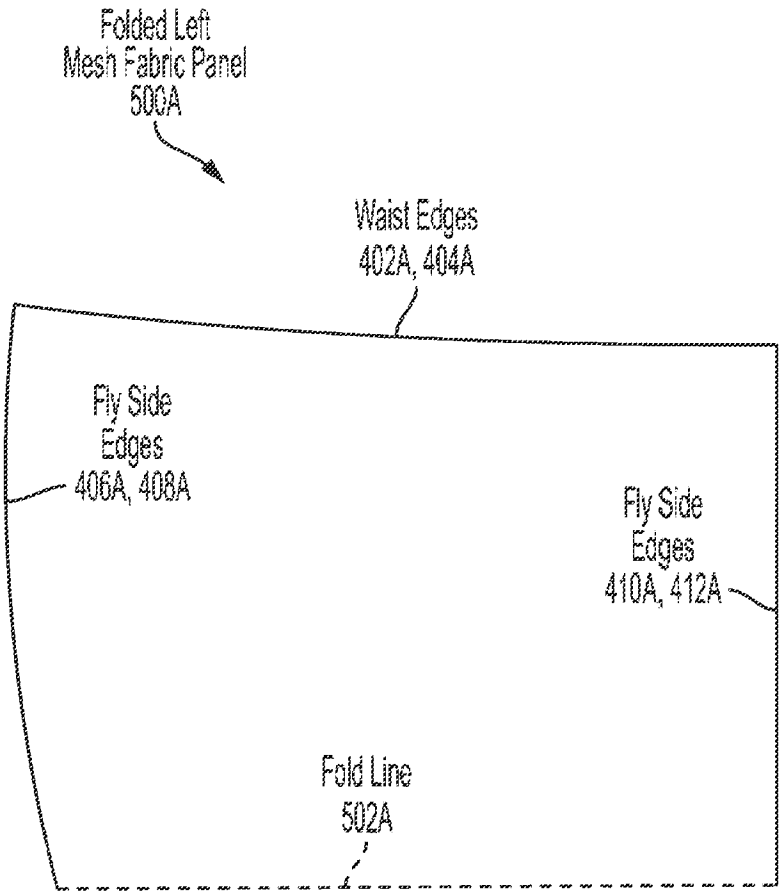
FIG. 5A depicts a left double mesh fabric panel obtained by folding the left mesh fabric panel of FIG. 4A along a medial line.
Figure 6:
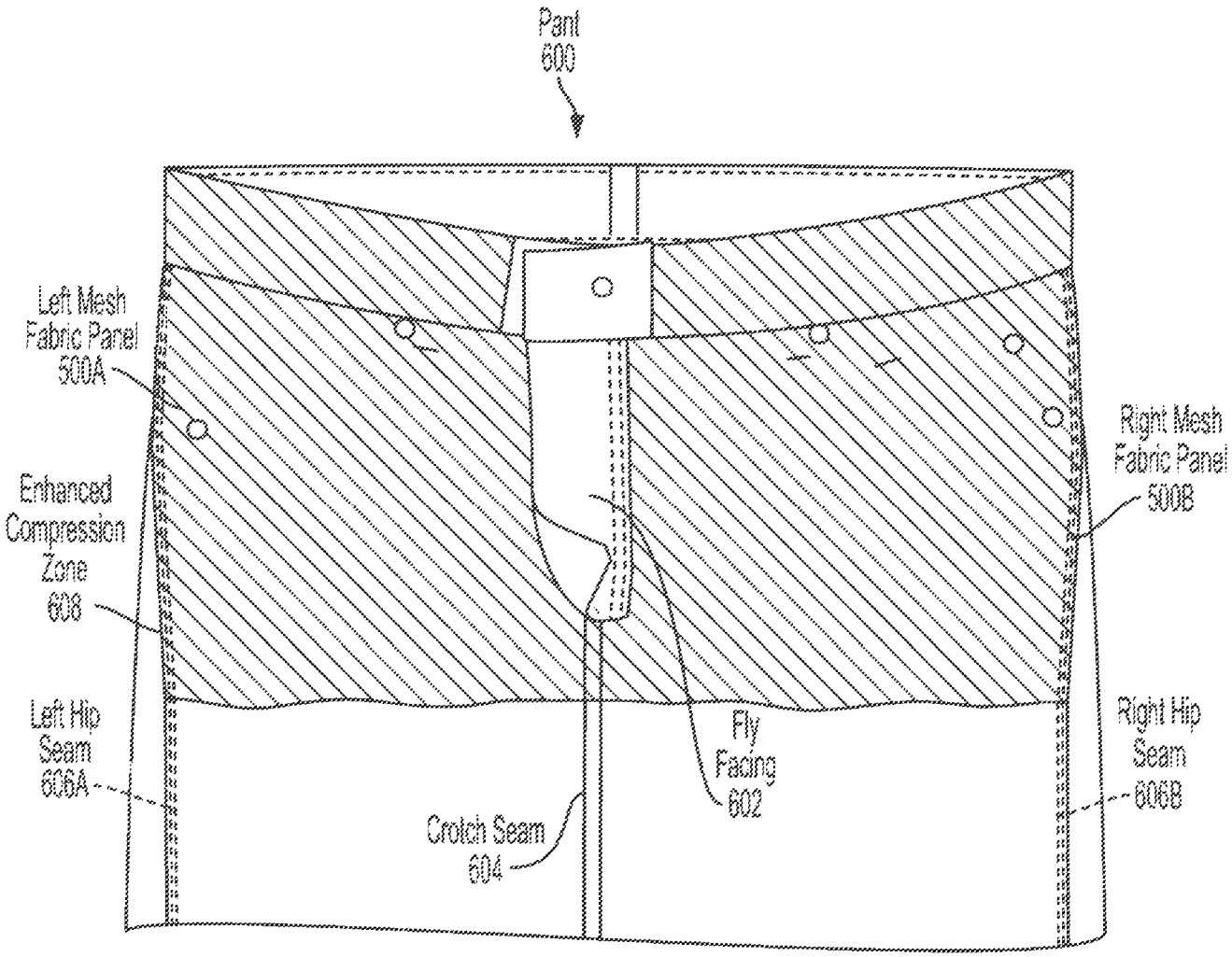
FIG. 6 depicts the left and right double mesh fabric panels of FIGS. 5A and 5B sewn into an example pair of pants in accordance with some embodiments.

FIG. 5A depicts a dual layer folded left mesh fabric panel 500A that is achieved by folding the left mesh fabric panel 400A at the medial line 414A. A fold 502A is generated at the medial line 414A that effectively becomes the bottom edge of the dual layer folded left mesh fabric panel 500A. When folded, the top and bottom portions of the left mesh fabric panel 400A overlap to form the dual layer left mesh fabric panel 500A. The dual layer left mesh fabric panel 500A is adapted to be sewn into a corresponding left side section of a tummy-covering garment, e.g. a pant as illustrated in FIG. 6.

As shown in FIG. 4A, the first waist edge 402A of the left mesh fabric panel 400A may have a concave shape. The first waist edge 402A is depicted as having a less pronounced curve (i.e., a larger radius of curvature) than the first waist edge 102A of the prior art left mesh fabric panel 100A.

However, in some embodiments, the first waist edge 402A may have a more pronounced curve (e.g., a smaller radius of curvature) or a less pronounced curve (e.g., a larger radius of curvature or possibly a straight edge) than what is shown. The first waist edge 402A may be formed with a curve that aligns with the shape of the waist seam of the tummy-covering garment onto which it will be affixed. The second waist edge 404A may be a mirror image of the first waist edge 402A (the mirror image of the same or substantially the same shape) across the medial line 414A. In other embodiments, the first waist edge 402A and the second waist edge 404A may have different shapes. For example, in some embodiments, one of the first waist edge 402A or the second waist edge 404A may be substantially linear while the other waist edge is curved.

In some embodiments, for a tummy-covering garment of the same particular size as discussed in relation to the prior art panels, e.g., size 18, the first waist edge 402A and the second waist edge 404B for a mirror image embodiment may have an unattached width of about 10.5". Thus, the unattached width of the first waist edge 402A and second waist edge 404A may be reduced by about 0.5" for the same pant (design and size) as compared to the unattached width of the first waist edge 102A and second waist edge 104A of the prior art left mesh fabric panel 100A.

In some embodiments, for the same pant (design and size) as described in relation to the prior art, the unattached length of the first seam side edge 406A (i.e., distance of the first seam side edge 406A from the first waist edge 402A to the medial line 414A) and the unattached length of the second seam side edge 408A (i.e., distance of the second seam side edge 408A from the second waist edge 404A to the medial line 414A) for a mirror image embodiment may be about 8". Thus, the unattached length of the first seam side edge 406A and second seam side edge 408A of the left mesh fabric panel 400A according to embodiments of the present invention may be increased by about 2" as compared to the unattached length of the first seam side edge 106A and second seam side edge 108A of the prior art left mesh fabric panel 100A. As a result of the top and bottom portions of the left mesh fabric panel 400A being mirror images, a seam side length of the double layer left mesh fabric panel 500A of FIG. 5A formed from folding the panel 400A at medial line 414A may be about 8".

In some embodiments, the unattached length of the first fly side edge 410A (i.e., distance of the first fly side edge 410A from the first waist edge 402A to the medial line 414A) may be about 7¼". The second fly side edge 412A for a mirror image embodiment (i.e., distance of the second fly side edge 412A from the second waist edge 404A to the medial line 414A) may also have an unattached length of about 7¼". Thus, the unattached length of the first fly side edge 410A and second fly side edge 412A may be increased by about 2" for the same garment (design and size) as compared to the unattached length of the first fly side edge 110A and second fly side edge 112A of the prior art left mesh fabric panel 100A. As a result of the top and bottom portions of the left mesh fabric panel 400A being mirror images, an unattached fly side length of the double layer left mesh fabric panel 500A formed from folding the panel 400A at the medial line 414A may be about 7¼".

Thus, for a tummy-covering garment such as a pant, the dual layer mesh fabric panel 500A according to some embodiments will extend below the pocket bags and the fly facing of the panel, unlike the prior art panels described herein. By going below the pocket bags and the fly facing, mesh fabric panels according to embodiments of the present invention achieve additional compression and shaping benefits while also making any pocket bag outline less visible.

As depicted in FIG. 4A, each of the first fly side edge 410A and the second fly side edge 412A may be linear and mirror images of each other across the medial line 414A. In some embodiments, the first fly side edge 410A and the second fly side edge 412A may be colinear. In other embodiments, the first fly side edge 410A and the second fly side edge 412A may not be colinear, that is, an angle may instead be formed therebetween above or below 180 degrees on the fabric side.

As further shown in FIG. 4A, each of the first seam side edge 406A and the second seam side edge 408A may have shaping that provides shaping benefits to the wearer. In some embodiments, each of the first seam side edge 406A and the second seam side edge 408A may have a reducing curve shape, such that the reducing curve only causes a decreasing width in the direction from the waist edge to the fold. In some embodiments, each of the first seam side edge 406A and the second seam side edge 408A may have an increasing and reducing curve shape, such that the curve first increases in width before then decreasing in width in the direction from the waist to the fold. In some embodiments, the second seam side edge 408A may be a mirror image of the first seam side edge 406A, having an identical or substantially the same curve albeit as a mirror image across the medial line 414A. In other embodiments, the first seam side edge 406A and the second seam side edge 408A may have different shapes. For example, one of the first seam side edge 406A or the second seam side edge 408A may be substantially linear while the other edge may be curved. In some embodiments, the first seam side edge 406A and/or the second seam side edge 408A may have a more or a less pronounced curve than depicted in FIG. 4A, in order to modify compression and/or shaping across the hip region. In some embodiments, e.g., in a reducing curve embodiment, an unattached fold width (i.e., a width of the fold 502A of the double layer left mesh fabric panel 500A) may be about 1" less than the unattached waist width (i.e., the width of the first waist edge 402A or second waist edge 404A). Thus, assuming an unattached waist width of the panel 500A that is about 10.5", the unattached fold width of the panel 500A may be about 9.5".

FIG. 4B depicts a right mesh fabric panel 400B that is a counterpart right mesh panel to the left mesh fabric panel 400A according to embodiments of the present invention. As with the left mesh fabric panel 400A depicted in FIG. 4A, the right mesh fabric panel 400B is depicted in an unfolded state prior to being folded at a medial line 414B and sewn into a tummy-covering garment such as a pant. The right mesh fabric panel 400B includes a first seam side edge 406B, a first fly side edge 410B, and a first waist edge 402B. The right mesh fabric panel 400B further includes a second seam side edge 408B, a second fly side edge 412B, and a second waist edge 404B. The medial line 414B extends across a center width of the panel 400B and separates a top portion of the panel 400B (defined by the medial line 414B, the first seam side edge 406B, the first fly side edge 410B, and the first waist edge 402B) from a bottom portion of the panel 400B (defined by the medial line 414B, the second seam side edge 408B, the second fly side edge 412B, and the second waist edge 404B).

As with the left mesh fabric panel 400A, the top portion and the bottom portion of the panel 400B may be mirror images of each other across the medial line 414B. That way, if the panel 400B is folded along the medial line 414B, the top portion and the bottom portion substantially overlap, and the first seam side edge 406B, the first fly side edge 410B, and the first waist edge 402B substantially correspond with the second seam side edge 408B, the second fly side edge 412B, and the second waist edge 404B, respectively.

FIG. 5B depicts a dual layer folded right mesh fabric panel 500B that is achieved by folding the right mesh fabric panel 400B at the medial line 414B. A fold line 502B is generated at the medial line 414B. The fold line 502B effectively becomes a bottom edge of the folded right mesh fabric panel 500B. When folded, the top and bottom portions of the right mesh fabric panel 400B overlap to form the dual layer mesh fabric panel 500B. The dual right mesh fabric layer panel 500B is adapted to be sewn into a right side section of tummy-covering garment, such as a pant as illustrated in FIG. 6.

Like the left mesh fabric panel 400A, the first waist edge 402B is depicted as having a less pronounced curve (i.e., a larger radius of curvature) than the first waist edge 102B of the prior art right mesh fabric panel 100B. However, in some embodiments, the first waist edge 402B may have a more pronounced curve (e.g., a smaller radius of curvature) or a less pronounced curve (e.g., a larger radius of curvature or possibly a straight edge). The first waist edge 402B may have a curve that aligns with the shape of the waist seam of the tummy-covering garment onto which it will be affixed. The second waist edge 404B may be a mirror image of the first waist edge 402B (a mirror image of the same or substantially the same shape). In other embodiments, the first waist edge 402B and the second waist edge 404B may have different shapes. For example, in some embodiments, one of the first waist edge 402B or the second waist edge 404B may be substantially linear while the other waist edge is curved.

Like the left mesh fabric panel 400A, each of the first seam side edge 406B and the second seam side edge 408B may have shaping to provide shaping benefits to the wearer. In some embodiments, as shown in FIG. 4B, each of the first seam side edge 406B and the second seam side edge 408B may have a reducing curve shape, such that the curve only causes a decreasing width in the direction from the waist to the fold. In some embodiments, each of the first seam side edge 406B and the second seam side edge 408B may have an increasing and decreasing curve shape, such that the curve first increases in width before decreasing in width in the direction from the waist to the fold. In some embodiments, the second seam side edge 408B may be a mirror image of the first seam side edge 406B, having an identical or substantially the same curve albeit as a mirror image. In other embodiments, the first seam side edge 406B and the second seam side edge 408B may have different shapes. For example, one of the first seam side edge 406B or the second seam side edge 408B may be substantially linear while the other edge may be curved. In some embodiments, the first seam side edge 406B and/or the second seam side edge 408B may have a more or a less pronounced curve than what is depicted in FIG. 4B, in order to modify compression and/or shaping across the hip region.

As shown in FIG. 4B, the right mesh fabric panel 400B may have an identical or substantially the same shape and dimensions as the left mesh fabric panel 400A, albeit with the left to right mesh fabric panels 400A, 400B being mirror images of one another and also possibly accounting for differences between the left seam of the fly facing and the right seam of the fly facing. That is, in some embodiments, the shapes of the left and right mesh fabric panels 400A, 400B may differ to account for attributes of the tummy-covering garment, e.g., the fly facing of a pant.

In particular, in some embodiments, the first waist edge 402B, the second waist edge 404B, the first seam side edge 406B, the second seam side edge 408B, the first fly side edge 410B, and the second fly side edge 412B of the right mesh fabric panel 400B may have similar example unattached dimensions as previously disclosed in relation to the first waist edge 402A, the second waist edge 404A, the first seam side edge 406A, the second seam side edge 408A, the first fly side edge 410A, and the second fly side edge 412A of the left mesh fabric panel 400A according to embodiments. Moreover, similar to the left mesh fabric panel 400A, the curves of the first seam side edge 406B and the second seam side edge 408B of the right mesh fabric panel 400B for a reducing curve embodiment result in an unattached fold width (i.e., a width of the fold 502B of the double layer right mesh fabric panel 500B) that is about 1" less than an unattached waist width (i.e., the width of the first waist edge 402B and second waist edge 404B).

More specifically, for a size 18 pant, and assuming no differences need to be accounted for between the left and right sides of the fly facing, the unattached width of each of the first waist edge 402B and the second waist edge 404B is about 10.5", the unattached length of each of the first seam side edge 406B and the second seam side edge 408B is about 8", and the unattached length of each of the first fly side edge 410B and the second fly side edge 412B is about 7.25". Moreover, due to a curve shape of the first and second seam side edges 406B, 408B, an unattached fold width of the panel 100B is about 9.5", i.e., about 1" less than the panel unattached waist width (10.5").

Referring now to FIG. 6, the left mesh fabric panel 400A and the right mesh fabric panel 400B according embodiments of the disclosure are depicted as being stitched into or otherwise affixed to the inside of an example pant 600. More specifically, the left mesh fabric panel 400A is folded at the medial line 414A to obtain the double layer left mesh fabric panel 500A, which is then sewn to the pant 600. In some embodiments, the first waist edge 400A and the second waist edge 404A of the double layer left mesh fabric panel 500A are stitched to a waist seam of the pant 400. In some embodiments, the left mesh fabric panel 400A may be eased in at the waist seam of the pant 600. In addition, in some embodiments, the first seam side edge 406A and the second seam side edge 408A are sewn to a left seam side of the pant 600, or more specifically, are sewn along a left hip seam 606A of the pant 600. Further, in some embodiments, the first fly side edge 410A and the second fly side edge 412A are sewn to a left side of a fly facing 602 of the pant 600. It should be appreciated that a corner of the fly facing 602 is shown in FIG. 6 as being flipped up to reveal a curved portion of the fly facing 602 underneath the flipped up corner. In some embodiments, because the left panel 500A extends below the fly facing 602, the fly side edges 410A, 412A may also be sewn to a crotch seam 610 of the pant 600.

In some embodiments, the right mesh fabric panel 400B is folded at the medial line 414B to obtain the double layer right mesh fabric panel 400B, which is then sewn to the pant 600. In some embodiments, the first waist edge 402B and the second waist edge 404B of the double layer right mesh fabric panel 500B are sewn to a waist seam of the pant 600. In some embodiments, the mesh fabric panel 500B may be eased in at the waist seam of the pant 600. In addition, in some embodiments, the first seam side edge 406B and the second seam side edge 408B are sewn to a right seam side of the pant 600, or more specifically, are sewn along a right hip seam 506B of the pant 500. Further, in some embodiments, the first fly side edge 410B and the second fly side edge 412B are sewn to a right side of the fly facing 602 of the pant 600. In some embodiments, because the right panel 500B extends below the fly facing 602, the fly side edges 410B, 412B may also be sewn to the crotch seam 610.

As depicted in FIG. 6, a length of the dual left mesh fabric panel 500A is longer than the front fly facing 602 and longer than a left pocket bag of the pant 600. Similarly, a length of the dual right mesh fabric panel 500B is longer than the front fly facing 602 and longer than a right pocket bag of the pant 600. The pocket bags are not shown in FIG. 6 as they are obscured from view by the longer mesh panels 500A, 500B. A length of the left mesh fabric panel 500A and/or the right mesh fabric panel 500B may be a length of a seam side edge, a length of a fly side edge, or any vertical distance from a waist edge to the fold line (bottom edge). The longer panels 500A, 500B provide a number of possible technical benefits including, without limitation: (1) preventing visibility of the panels 500A, 500B through the pant 600, (2) preventing rolling up of the panels 500A, 500B, which can cause wearer discomfort, and/or (3) lowering the compression zone to the lower hip zone thereby increasing comfort.

In some embodiments, an unattached width of each of the left and right mesh fabric panels 500A, 500B at the waist seam is approximately the same as the waist seam of the pant 600. In particular, assuming the panels 500A, 500B are sized and shaped for a size 18 pant, the unattached waist width of the panels 500A, 500B (e.g., the unattached width of a panel waist edge) is about 10.5", which is approximately the same as the width of the waist seam of the pant 600. Moreover, in some embodiments, an unattached fold width of each of the left and right mesh fabric panels 500A and 500B at the bottom edge may be about 0.75" narrower than a width of the pant section at a corresponding distance from the waist seam. In particular, again assuming the panels 500A, 500B are sized and shaped for a size 18 pant, the unattached fold width of each panel 500A, 500B is about 9.5" and the width of the pant section at a corresponding distance from the waist seam is about 10.25". The width of the pant section at the corresponding distance from the waist seam as the fold line (e.g., 10.25") is narrower for the panels 500A, 500B according to embodiments of the present invention than it is for the prior art panels 200A, 200B (e.g., 10.75) because the panels 500A, 500B are longer than the prior art panels 200A, 200B, and thus, the fold line of the panels 500A, 500B sits at a lower position of the pant than the fold line of the panels 200A, 200B.

As previously noted, the example dimensions provided herein for the panels 500A, 500B are unattached dimensions before the panels 500A, 500B are sewn into the pant 600 and include about a 0.5" tolerance at each sewn edge. Accordingly, each of the left and right mesh fabric panels 500A, 500B lose up to 1" in width at the waist when the first waist edge and second waist edge sewn are sewn at the waist seam and lose up to 0.5" at each of the seam side and the fly side. Thus, assuming a size 18 pant and the example panel dimensions described earlier, after each panel 500A, 500B is sewn into a respective front section of the pant 600, the attached waist line width of each panel may become about 9.5", the attached length of the seam side edges may become about 7.5", and the attached length of the fly side edges may become about 6.75". Further, after being sewn into the pant 600, each panel 500A, 500B may have an attached fold line width of about 8.5" due to a total loss of up to 1" including a loss of 0.5" from being sewn at the seam side and another 0.5" from being sewn at the fly side.

As noted above, after being sewn into the pant 300, each panel 500A, 500B has an attached waist seam width of about 9.5, while the waist seam width of a corresponding section of the pant 600 is about 10.5". Further, as noted above, after being sewn into the pant 600, each panel 500A, 500B has an attached fold line width of about 8.5", and a width of the pant section at a corresponding distance from the waist seam as the fold line is about 10.25". The difference between the attached fold line width of each panel 500A, 500B and the width of the pant section at a corresponding distance from the waist seam as the fold line, for example, generates an enhanced compression zone as compared to the prior art panels 200A, 200B. This enhanced compression zone translates to about 2.5" of compression at the high hip zone which, in turn, corresponds to about 4.63% of compression.

Thus, in various embodiments, the mesh fabric panels 500A, 500B provide improved compression zoning as compared to the prior art panels 200A, 200B. In particular, as previously noted, each of the prior art panels 200A, 200B provides 1.85% of compression at the high hip and 0.93% of compression at the bottom edge. In contrast, each of the panels 500A, 500B according to embodiments of the present invention, due at least in part to the reducing curve that generates a shorter fold line width than waist edge width, provides significantly more compression (about 2.5" in some embodiments) at the mid to lower panel (which is positioned even lower than the prior art panels 200A, 200B because the panels 500A, 500B are longer). This, in turn, results in the greater compression (4.63%) observed at the high hip zone for the panels 500A, 500B. In particular, the panels 500A, 500B according to embodiments of the present invention both extend the compression zone as well as shift a greater proportion of the compression from the waist region of a wearer's body to a high hip zone of the wearer's body, as compared to the prior art panels 200A, 200B.

Example body measurements of a size 18 body might include a high hip measurement of 54" and a low hip measurement (below hip bone) of 55". The prior art mesh fabric panels 200A, 200B may compress a size 18 body such that the high hip measurement compresses to about 53" (compression of 0.5" from each prior art panel 200A, 200B) and the low hip measurement compresses to about 54.5" (compression of 0.25" from each panel 200A, 200B). In contrast, the mesh fabric panels 500A, 500B according to embodiments of the present invention may compress a size 18 body such that the high hip measurement compresses to about 51.5" (compression of about 1.25" from each panel 500A, 500B) and the low hip measurement compresses to about 54.5" (compression of about 0.25" from each panel 500A, 500B). Notably, the mesh fabric panels 500A, 500B generate approximately 1.5" more compression on the high hip zone as compared to the prior art mesh fabric panels 200A, 200B, but do not compromise comfort on the lower hip area, thereby supporting ease of movement. The example dimensions provided herein correspond to a size 18 pant and a particular full-bodied shape. Other dimensions are within the scope of this disclosure and may be chosen for a different pant size and/or a differently shaped pant.

Thus, panels 500A, 500B according to example embodiments of the present invention provide an expanded compression zone as compared to the prior art panels 200A, 200B. This expanded compression zone includes a particularly significant increase in compression at the mid-panel (which is approximately at the high hip zone), which provides tummy flattening benefits without adding significant compression at the waist, and thereby avoids pinching and discomfort at the waist. Moreover, in some embodiments, the reduced width at the waist edge of the mesh fabric panels 500A, 500B as compared to the prior art mesh fabric panels 200A, 200B reduces digging at the waist without compromising comfort.

In addition to the expanded compression zone provided by the panels 500A, 500B according to embodiments of the present invention, in some embodiments, the shape and size of the panels 500A, 500B shifts a larger portion of the total compression from the high hip zone to the low hip zone as compared to the prior art panels 200A, 200B. More specifically, by virtue of having a reduced width at the bottom edge, the mesh fabric panels 500A, 500B pull and tighten the compression area at the upper to mid tummy and create an enhanced compression zone 408 that increases the proportion of the total compression that is applied to the front upper belly area of the wearer as compared to the prior art panels 200A, 200B. In particular, the curved shape of the seam side edges may contribute to improved shaping as well as the shift in the ratio of compression that is applied to the lower hip zone as compared to the upper hip zone. Further, in some embodiments, the curved shape of the seam side edges may be greater than a curvature of the pant section itself, thereby providing an even further enhanced compression function and/or improved compression shaping.

In some embodiments, the mesh fabric panels 500A, 500B may also provide improved panel shaping over the prior art panels 200A, 200B. In particular, the prior art panels 200A, 200B include a substantially straight (albeit angled) edge along the hip seam, while the panels 500A, 500B have a curved shape (possibly a reducing curve shape) along the hip seam. The curved shape of the panels 500A, 500B along the hip seam enhances panel shaping.

In some embodiments, the double mesh fabric of the mesh panels 500A and 500B, for example, increases the rigidity of the front of a garment beyond that which would be provided by a single layer mesh, although embodiments having a single mesh fabric are possible. That is, in some embodiments, one or more of the mesh fabric panels may include only a single layer. A single layer mesh fabric panel may be similarly sewn to a garment at the seam side, fly side, and the waist.

In some embodiments, a double layer mesh fabric panel may be used, but the fold line may occur elsewhere such as, for example, at the waist, on the fly side, or on the seam side. Further, in some embodiments, a top portion of a mesh fabric panel may be formed of a first power mesh material, while the bottom portion of the mesh fabric panel may be formed of a second, different power mesh material or non-mesh material. In this manner, a double layer fabric panel formed of two different materials may provide enhanced rigidity as compared to a single layer mesh fabric panel. In some embodiments, a bottom/lower edge of the single or double layer mesh panel may be sewn to the garment or may remain free.

Although embodiments described above have been shown as including two separate panels, some embodiments can be made using a single, integral mesh fabric panel. Some embodiments may include three or more sections, e.g., a left panel, a right panel and center panel (or multiple intermediate panels). In some embodiments, the fabric need not be folded, but can include two separate layers of mesh fabric, one layer of mesh fabric adjacent a layer of non-mesh fabric, and/or combinations of the like. In some embodiments, three or more layers may be used.

Figure 7:
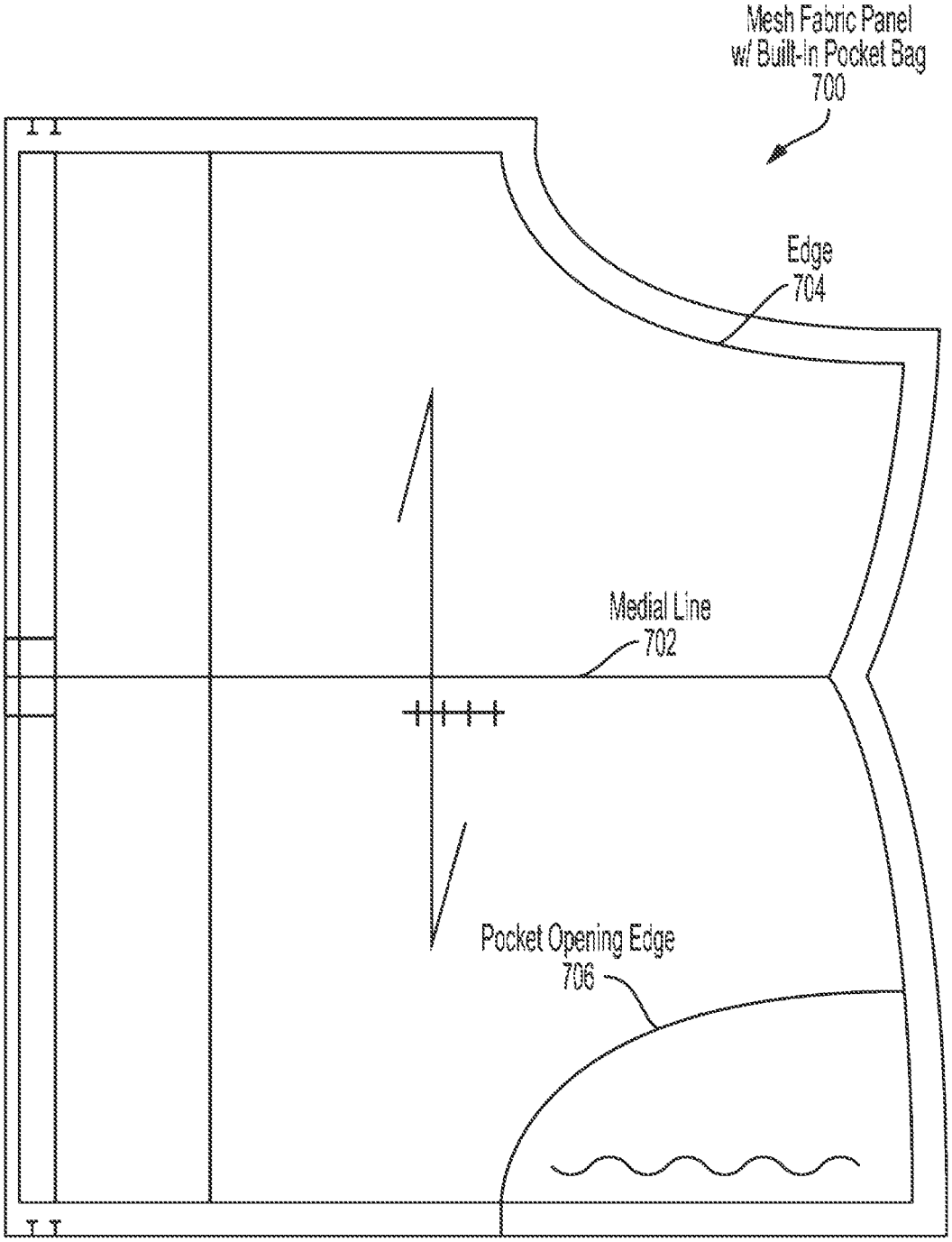
FIG. 7 depicts a mesh fabric panel with a built-in pocket bag in accordance with some alternative embodiments.
Figure 8:
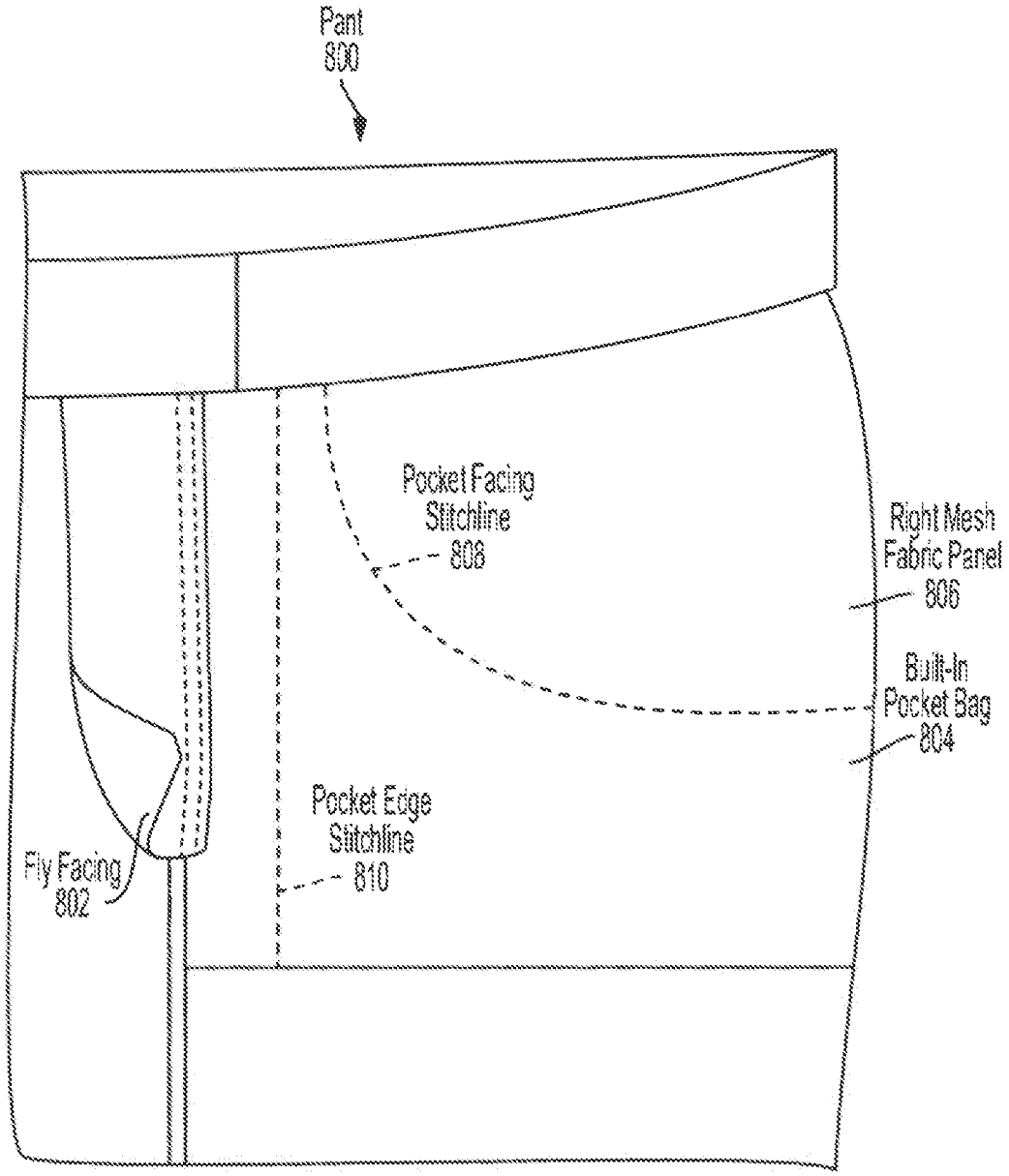
FIG. 8 depicts the mesh fabric panel of FIG. 7 with built-in pocket bag when folded along a medial line and sewn into an example pair of pants in accordance with some alternative embodiments.

FIG. 7 depicts an example mesh fabric panel 700 having a built-in pocket bag. The panel 700 is depicted in an unattached state. The mesh fabric panel 700 has a medial line 702. The mesh fabric panel 700 can be folded at the medial line 702 to bring a top portion of the panel 700 and a bottom portion of the panel 700 together. An edge 704 of the panel 700 may coincide with a pocket opening edge 706 when the panel 700 is folded at the medial line 702. The edge 706 and the pocket opening edge 706 can be sewn together to form a dual layer panel 806 having a built-in pocket bag, which is depicted in FIG. 8 as being sewn to a pant 800.

In some embodiments, the mesh fabric panel 806 may have about the same size, shape, and/or dimensions as the right mesh fabric panel 500B (e.g., may be longer than a fly facing 802 of the pant 800), but further includes the built-in pocket bag 804. In some embodiments, the mesh fabric panel 806 may have about the same size, shape, and/or dimensions as the right mesh fabric panel 200B, but further includes the built-in pocket bag 804. A pocket edge stitch line 810 and a pocket facing stitch line 808 are shown in FIG. 8. Integrating the pocket bag 804 into the double layer mesh panel 806 eliminates further risk of visible lines caused by separate pocket bags. As depicted, integrating the pocket bag 804 into the mesh fabric panel 806 may, along with the vertical pocket edge stitch line and the pocket facing stitch line 808, create one seamless panel with no separate pocket bag needed. While the integrated pocket bag 804 is depicted with respect to the example mesh fabric panel 500B, it should be appreciated that any of the mesh fabric panels according to embodiments described herein can be modified to incorporate a built-in pocket bag.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or integral component. Similarly, structures and functionality presented as a single component may be implemented as separate components. These and other variations, modifications, additions, and improvements fall within the scope of the subject matter herein.

Those skilled in the art will recognize that various modifications may be made, and other embodiments may be used without departing from the broader scope of the present invention(s). Therefore, these and other variations upon the example embodiments are intended to be covered.

The invention claimed is:

1. A tummy-covering garment having mesh fabric panels configured to apply a compressive force to a wearer of the tummy-covering garment, the tummy-covering garment comprising:

a waist seam, a left hip seam, and a right hip seam;

a left mesh fabric panel including:

a first left waist edge affixed to the waist seam;

a second left waist edge;

a first left panel seam side edge affixed to the left hip seam, the first left panel seam side edge having a reducing curved shape from the first left waist edge towards a left fold line;

a second left panel seam side edge having the reducing curved shape from the second left waist edge towards the left fold line and that meets the first left panel seam side edge at the left fold line;

a first left panel medial edge affixed to a medial front of the tummy-covering garment;

a second left panel medial edge affixed to the medial front of the tummy-covering garment and that meets the first left panel medial edge at the left fold line; and a left bottom edge opposite the first and second left waist edges when folded at the left fold line, the left bottom edge being defined by a fold that is created when the left mesh fabric panel is folded at the left fold line, thereby creating a dual layer left mesh fabric panel, the reducing curved shape reducing in a direction from the first and second left waist edges towards the left bottom edge, creating greatest width at the first and second left waist edges and decreasing width in the direction from the first and second left waist edges towards the left bottom edge, the reducing curved shape being more pronounced than a garment curve along the left hip seam of the tummy-covering garment, the left bottom edge providing greater compression than the first and second left waist edges; and a right mesh fabric panel including:

a first right waist edge affixed to the waist seam;

a second right waist edge;

a first right panel seam side edge affixed to the right hip seam, the first right panel seam side edge having a reducing curved shape from the first right waist edge towards a right fold line;

a second right panel seam side edge having the reducing curved shape from the second right waist edge towards the right fold line and that meets the first right panel seam side edge at the right fold line;

a first right panel medial edge affixed to the medial front of the tummy-covering garment;

a second right panel medial edge affixed to the medial front of the tummy-covering garment and that meets the first right panel medial edge at the right fold line; and a right bottom edge opposite the first and second right waist edges when folded at the right fold line, the right bottom edge being defined by a fold that is created when the right mesh fabric panel is folded at the right fold line, thereby creating a dual layer right mesh fabric panel, the reducing curved shape reducing in a direction from the first and second right waist edges towards the right bottom edge, creating greatest width at the first and second right waist edges and decreasing width in the direction from the first and second right waist edges towards the right bottom edge, the reducing curved shape being more pronounced than a garment curve along the right hip seam of the tummy-covering garment, the right bottom edge providing greater compression than the first and second right waist edges.

2. The tummy-covering garment of claim 1, wherein the dual layer left mesh fabric panel or the dual layer right mesh fabric panel includes a built-in pocket bag.

3. The tummy-covering garment of claim 1, wherein each of the first left panel seam side edge, the first right panel seam side edge, the first left panel medial edge and the first right panel medial edge is longer than a pocket bag of the tummy-covering garment such that each of the left bottom edge and the right bottom edge sits below a bottom edge of the pocket bag when affixed to the tummy-covering garment.

4. The tummy-covering garment of claim 1, wherein the first left waist edge has a curved shape.

5. The tummy-covering garment of claim 4, wherein the second left waist edge has the curved shape.

6. The tummy-covering garment of claim 1, wherein the first left panel medial edge is substantially linear.

7. The tummy-covering garment of claim 6, wherein the second left panel medial edge is substantially linear.

8. The tummy-covering garment of claim 1, wherein the first left waist edge, the first left panel seam side edge, the first left panel medial edge, and the left fold line define a top portion of the left mesh fabric panel; the second left waist edge, the second left panel seam side edge, the second left panel medial edge, and the left fold line define a bottom portion of the left mesh fabric panel; and the top portion and the bottom portion substantially overlap when the left mesh fabric panel is folded at the left medial fold line.

9. The tummy-covering garment of claim 1, wherein the first right waist edge, the first right panel seam side edge, the first right panel medial edge, and the right fold line define a top portion of the right mesh fabric panel; the second right waist edge, the second right panel seam side edge, the second right panel medial edge, and the right fold line define a bottom portion of the right mesh fabric panel; and the top portion and the bottom portion substantially overlap when the right mesh fabric panel is folded at the right medial line.

* * * * *